United States Patent [19]

Pagano

[11] Patent Number: 4,691,545

[45] Date of Patent: Sep. 8, 1987

[54] SAFETY LOCK WITH PLURAL TUMBLERS, HAVING A SHAPED CONSENT STUD

[75] Inventor: Amleto Pagano, Turin, Italy

[73] Assignee: SETEC s.r.l., Turin, Italy

[21] Appl. No.: 592,454

[22] Filed: Mar. 20, 1984

[51] Int. Cl.[4] ..... E05B 21/00

[52] U.S. Cl. ..... 70/352; 70/385

[58] Field of Search ..... 70/319, 385, 347, 348, 70/352, 382, 384

[56] References Cited

U.S. PATENT DOCUMENTS

| | | | |
|---|---|---|---|
| 701,230 | 5/1902 | Taylor | 70/385 |
| 799,666 | 9/1905 | Oleschak | 70/376 |
| 889,543 | 6/1908 | Ozorozy | 70/352 |
| 1,826,595 | 10/1931 | Benham | 70/385 |
| 3,653,238 | 4/1972 | Brugeman | 70/377 X |
| 3,673,830 | 7/1972 | Billino | 70/352 |
| 3,762,192 | 10/1973 | Errani | 70/419 X |
| 4,357,815 | 11/1982 | Kleefeldt et al. | 70/377 X |

FOREIGN PATENT DOCUMENTS

| | | | |
|---|---|---|---|
| 575788 | 4/1924 | France | 70/352 |
| 699641 | 2/1931 | France | 70/352 |
| 17176 | of 1891 | United Kingdom | 70/352 |

*Primary Examiner*—Robert L. Wolfe
*Assistant Examiner*—Lloyd A. Gall
*Attorney, Agent, or Firm*—Young & Thompson

[57] ABSTRACT

A safety lock with gorge levers, intended to be operated by a web-type key, in which the consent stud, connected to the plate with latches and traversing the windows with opposite teeth of the gorge levers, instead of being prismatic as usual, has an outline with projections and recesses depending on the shape of the key web and on the configuration of the windows of the gorge levers, while these latter are identical for locks intended to be operated by different keys, whereby the shaped consent stud is the only element differentiating each specific lock.

Preferably the shaped consent stud is interchangeably mounted on the plate with latches, whereby the lock can be easily adapted to be operated by a different key, by simply replacing the interchangeable shaped consent stud.

3 Claims, 12 Drawing Figures

SAFETY LOCK WITH PLURAL TUMBLERS, HAVING A SHAPED CONSENT STUD

BACKGROUND OF THE INVENTION

This invention relates to a lock of the type intended to be operated by a web-type key, comprising a plate with latches which is actuated by said key and having a consent stud, and a set of tumbler actuated by the same key and each having a window with teeth, said window being traversed by said consent stud of the plate with latches, in order to allow the displacement of the stud and the latches only by action of a key whose web is provided with a predetermined sequence of projections and recesses.

In the known constructions, said consent stud of the plate with latches has the shape of a prism with a constant cross-section, and the teeth of the windows of the various tumblers have each a length determined as a function of the radius, relative to the axis of rotation of the key, of the corresponding projection or recess of the web, the recesses being defined by and between the projections, whereby, under the action of the key, the free spaces between the teeth of the windows of all tumblers come into alignment to allow the consent stud of the plate with latches to pass between them. In the locks with a key having two opposite non-symmetrical webs, the teeth of even position of each tumbler are not equal to the teeth of odd position of the same tumbler lever, because this provision makes more difficult the unauthorized opening of the lock. However, these constructions have some disadvantages.

A first disadvantage of the known locks of the type being considered consists in the high construction and assembly costs, due to the fact that a lot of tumblers are to be provided, each of them corresponding, as regards the length of the teeth of its windows, to a specific pair of measures of the projections and the opposite recesses of the key, and once the key intended to actuate a specific lock has been manufactured, the lock must be assembled by choosing, in the correct sequence, the different tumblers corresponding to the successive pairs of projections and recesses of the key. The manufacture of the different tumblers requires use of a lot of different dies or of an expensive die with slides to be set exactly into various pre-established positions, and the assembly of the lock requires the attentive intervention of skilled operators.

Another disadvantage of the locks in question consists in that it is not possible to modify at a later time a lock constructed for being actuated by a certain key, so as to make it operable by a different key, as would be desirable whenever the original key had to be entrusted to a person who can perhaps have provided a duplicate thereof, a case which routinely occurs when installing the lock, if this latter is not personally installed by the user, and is often repeated on the occasion of work being carried out on the premises protected by the lock and on other occasions. Such a modification is possible, even if at the cost of a relatively difficult operation and the replacement of a complex component, in some types of cylinder locks, which on the other hand have a safety degree which is smaller than that of the tumbler locks.

BRIEF SUMMARY OF THE INVENTION

The first object of the present invention is to eliminate the first above mentioned disadvantage of the known tumbler locks, by providing a lock of the type to be operated with a web-type key, in which the entire set of tumblers should be identical in the locks intended to be operated by different keys, thus allowing a complete standardization of the operations of assembling the sets of tumblers, and hence the use of unskilled labor or even the automation of the operations.

This object is attained, according to the invention, by the facts that the tumblers forming said sets of tumblers are provided in their windows with teeth whose sizes are predetermined independently from the configuration of the web of the key intended to operate the lock, and that said consent stud of the plate with latches is shaped to have a profiled outline cooperating with the windows of the various tumblers, each section of the consent stud having a size determined as a function of the radius of the corresponding projection or recess of the key and of the size of the teeth of the corresponding tumbler, so that the consent stud may freely pass between the teeth of the windows of the tumblers when these latter have been moved by the pre-established key.

With these arrangements, the tumblers displaced by the correct key do in no way expose aligned free spaces between the teeth of their windows but, nevertheless, they allow the passage of the consent stud because this latter has a shape corresponding to that of the free space between the teeth of the windows of the thus displaced tumblers. The locks having these features are provided with non-differentiated sets of tumblers, which can be provided by non-intelligent or automated operations without taking into account the configuration of the key which will have to operate the lock, and this allows reducing in a substantial manner the cost of the assembly operations.

The differentiation of each individual lock is obtained by inserting a single element provided as a function of the configuration of the key, i.e. the shaped consent stud, and this represents the minimal unavoidable charge for the differentiation of the locks. The manufacturing costs of the tumblers also become greatly reduced because, even when all the tumblers of a set are different from each other, the number of different tumblers to be produced corresponds to the number of tumblers forming the set of tumblers of the lock, which is far smaller than the number of different tumblers which are to be provided for the differentiation of the known locks, even when these latter pertain to the so-called fixed constant types. The higher cost of production of the shaped consent stud in comparison with a conventional prismatic stud counteracts but a small part of the economical and organizational advantages thus obtained.

Preferably, the set of tumblers comprises odd position gorge levers all equal to each other and even position tumblers also equal to each other but not equal to the odd position tumblers.

Thanks to this feature, the number of different tumblers to be manufactured is reduced to two only, which, with keys having two opposite webs, represents the minimum number consistent with the maintenance of the safety degree inherent in the position of the tumblers being alternatively different in the odd turns and in the even turns, i.e. in the two webs of the key being not symmetrically opposite to one another. In this way, the manufacturing cost of the tumblers of the locks is reduced to the minimum possible value.

A second object of the invention is to remove also the second of the above mentioned disadvantages of the known tumbler type locks, by providing a lock which, though having the safety degree of the locks with a web-type key, may be modified at any moment for being operated by a key different from the preceding one, by an operation which can be carried out by the same user without intervention of third parties.

This object is attained, according to the invention by the facts that the shaped consent stud is disassemblably and interchangeably mounted onto the plate with latches, and that the spaces provided between the successive teeth within the windows of the tumblers have a height not less than the height of the highest projections of the consent stud.

Thanks to this feature, the adaptation of a lock to a new key is obtained by simply replacing the existing shaped consent stud, corresponding to the old key, by a new consent stud shaped in a different manner, corresponding to the new key. It is not necessary to modify the set of the tumblers, which do not constitute an individualizing element of the lock. The substitution of the shaped consent stud is allowed by the stated sizing of the spaces between successive teeth in the windows of the tumblers, which enables the consent stud to be extracted from and introduced into said windows without being hindered by the tumblers when these latter are in the rest position.

In order to render more easy and reliable the adaptation of the lock to a new key, it is possible to commercialize series being of keys, each series accompanied by a corresponding consent stud, enclosed in sealed wrappings externally not differentiated from each other and such as not to allow the examination of the outline of the keys and of the consent stud contained therein before opening the wrappings.

Preferably, said interchangeable consent stud is accessible through an opening of the inner side of the lock casing, situated in a location corresponding to a specific position of the plate with latches with which the consent stud moves.

Thanks to this feature it is possible to avoid that the substitution of the consent stud could be carried out by an unauthorized person without actuating the lock. In particular, by choosing said specific position of accessibility different from the opening position of the lock, it is prevented that the consent stud could be, for example, disassembled for fun by children, while by choosing said specific position also different from that of complete closure it is avoided that the substitution could be carried out for facilitating an unauthorized person to leave a place that he may have entered by another route.

Preferably, said specific position of accessibility is selected in a location corresponding to an intermediate turn of the lock, i.e. a position in which the lock is never normally left.

BRIEF DESCRIPTION OF THE DRAWINGS

These and other features and advantages of the invention will be more clearly apparent from the following description of some embodiments of the invention, given by way of non-limiting examples, and diagrammatically shown in the annexed drawings, in which.

DETAILED DESCRIPTION OF THE PREFERRED EMBODIMENTS

Figure 5:
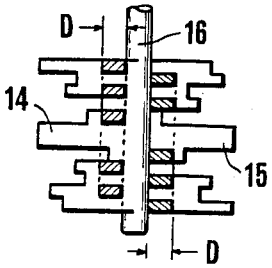
FIG. 5 shows the shape of the key web which corresponds to the consent stud of FIG. 4 when tumblers with windows according to FIGS. 2 and 3 are used.
Figure 1:
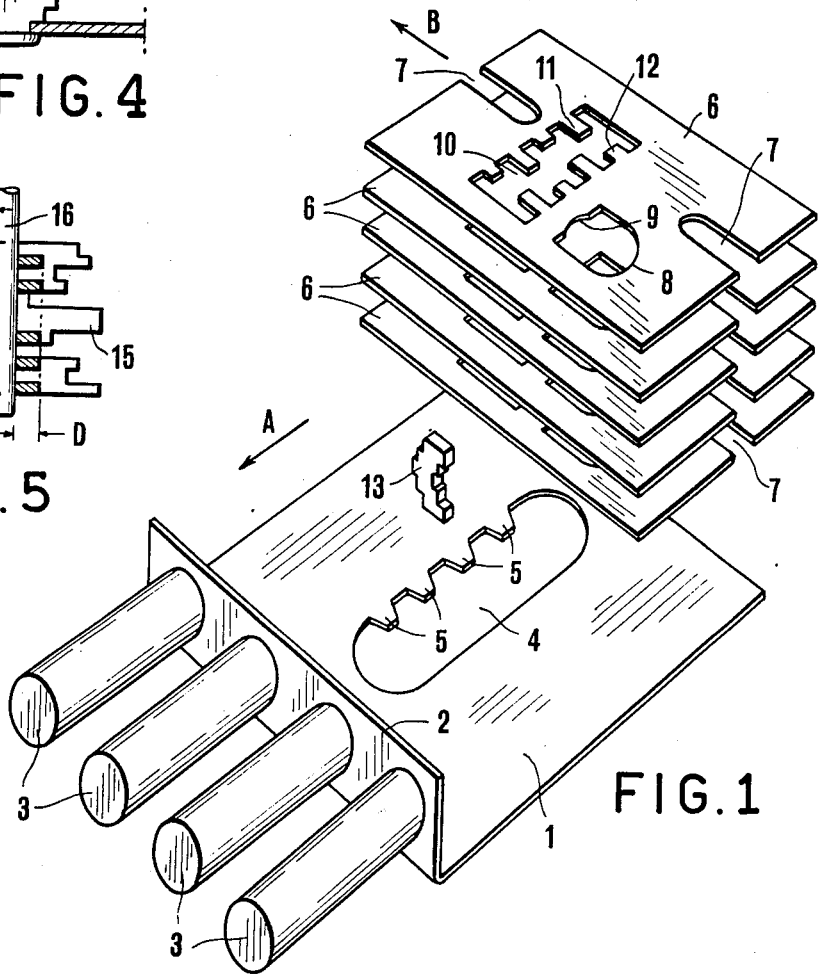
FIG. 1 is an exploded perspective view of the main part of the mechanisms of a lock according to the invention.

In FIG. 1 of the drawings there is shown the system of latches of a tumbler-type lock, which system is formed by a plate 1 with a bent portion 2 supporting the latches 3 intended to engage a prong (not shown) cooperating with the lock. Formed in the plate 1 there is a window 4, a rim of which forms teeth 5 intended to be engaged by a central portion of the opposite webs 14,15 of a double web type key (FIG. 5) in order to advance by successive turns the system of latches in the direction of the arrow A, thereby engaging said latches in the prong.

In order to allow the lock to be operated only by the key intentionally provided to this end, on the plate 1 there is stacked a number of tumblers 6 (five in number in this example), provided with slits 7 by means of which they are guided by pins (not shown) rigidly connected to the casing (also not shown in FIG. 1) of the lock, so that the tumblers 6 are guided to slide in the direction of the arrow B, perpendicular to the direction A of the movement of plate 1. Each tumbler 6 has an opening 8 into which the key penetrates as it is inserted into the lock, and a rim 9 of this opening cooperates with a corresponding projection or recess of the key, on rotation of this latter, thus moving the tumbler 6 in the direction of arrow B against the action of return springs (not shown), acting against arrow B. Tumbler 6 thus displaces up to a position depending on the radius, relative to the axis of rotation of the key (axis of the keyhole 27), of the projection or recess of the web, which has cooperated with the tumbler being considered. Each tumbler 6 is further provided with a window 10 extending perpendicularly to the movement direction B of the tumblers, and projecting into the window 10 there are pairs of opposite teeth 11 and 12. For locks operated by keys with two opposite webs, the length is usually different for the even and the odd teeth, which implies that the two webs of the key be asymmetrical to one another, and produces a higher degree of safety.

In the known locks, the teeth 11 and 12 are sized in such a way that, when the tumblers 6 have been displaced by the correct key, the spaces between opposite teeth 11 and 12, corresponding to the turn being carried out, of the various tumblers, become aligned and allow the passage, between all the thus aligned teeth, of a prismatic consent stud fixed to the plate 1, thus allowing the plate and the latches to be made to advance in the direction A by rotation of the key. This implies that the lengths of the even and odd teeth 11 and 12 of each tumbler 6 are sized as a function of the radiuses of the corresponding opposite projections or recesses of the key web, with the constructional and assembling consequences stated in the preamble.

On the contrary, in the practice of the invention the sizes of the even and the odd pairs of teeth 11 and 12 of each tumbler 6 are chosen without any relation to the configuration of the key web. It follows that the spaces between opposite teeth 11 and 12, corresponding to the turn being carried out, do in no way become aligned among the various tumblers 6, even when the key which operates the lock is the correct one. However, the possibility of displacement of the plate 1 having latches is restored by the fact that to said plate 1 is applied a consent stud 13 which, instead of being prismatic, is shaped with such an outline that each cross section of it, registering with a tumbler 6, will become situated exactly where the free space between opposite teeth 11 and 12 of the considered tumbler 6 is located when the key which operates the lock is correct.

Therefore, the consent stud 13 shows a number of superposed sections, each of which forms, at the one and the other side of the stud 13, a projection or recess whose position depends on the radius of the corresponding projection or recess of the key, and on the configuration of the corresponding tumbler 6 of the lock.

Of course, as the configuration of each tumbler 6 of the set of tumblers of the lock is preestablished and constant, it is possible to select a specific outline of the consent stud 13 and to deduce therefrom the profile of a corresponding key, or vice versa, whatever the configuration of the windows of the tumblers 6 may be. The construction of the tumblers 6 is simplified at a maximum when all the tumblers 6 of odd position are made equal to each other, and all the tumblers 6 of even position are also made equal to each other, but not equal to the tumblers 6 of odd position. This condition maintains the maximum safety degree for the lock.

Figure 4:
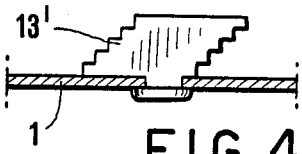
FIG. 4 shows an example of a consent stud of the lock having an outline like regular stairs.
Figure 2:
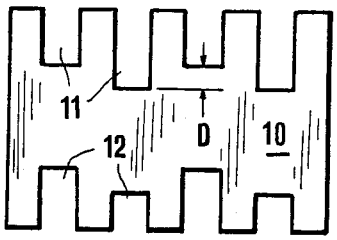
FIGS. 2 and 3 show in detail the shape of the windows of the tumblers of odd position and of the levers of even position, respectively, of the lock.
Figure 3:
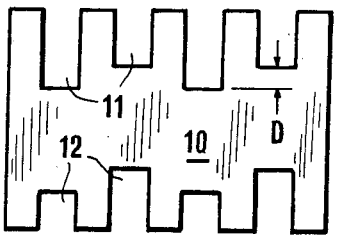

Therefore, the windows of the odd tumblers may be configured, for example, according to FIG. 2, and those of the even tumblers according to FIG. 3. These windows differ from one another by a displacement in opposite directions of the pairs of teeth corresponding to the successive turns. Indicating by D this displacement, a similar displacement D is applied, alternatively in opposite directions, to the projections and recesses of the webs 14 and 15 of a key 16, relative to the corresponding projections and recesses of the shaped consent stud 13, as can be seen particularly by comparing the FIGS. 5 and 4. In this latter Figure, a shaped stud 13' having the shape of regular stairs has been shown, in order to make more evident the comparison.

An important consequence of using a shaped consent stud instead of differentiated sets of tumblers, in order to individualize the lock, is that the number of combinations obtainable in a lock (and hence the number of different keys which may be provided for) becomes practically unlimited.

Due to the fact that the set of tumblers of a lock according to the invention is not bound to the configuration of the key, and the element which differentiates each single lock in order to recognize the respective key is only the shaped consent stud 13 mounted on the plate 1 with latches, it follows that only said shaped stud need be adapted to the key in the construction of the lock. Therefore, as a further development of the invention, each lock can be adapted to be operated by different keys, if the shaped consent stud 13 is made to be interchangeable, and different sets comprising a number of keys and a correspondingly shaped consent stud are made available.

Figure 8:
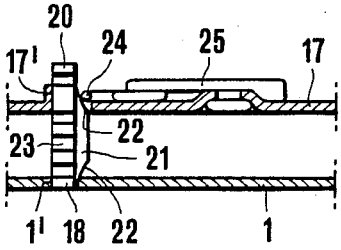
FIG. 8 shows the interchangeable consent stud of FIG. 6 as it is seen in profile, with the means for retaining it shown in a partially sectional view.
Figure 10:
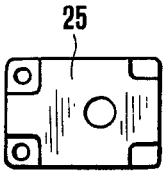
FIG. 10 shows a plaque intended for fastening the spring according to FIG. 9.
Figure 9:
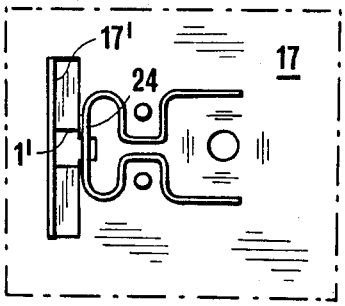
FIG. 9 is a plan view of a retention spring for the interchangeable consent stud.

In an embodiment, some particulars of which are shown in FIGS. 6 to 10, the system of latches comprises, in addition to the base plate 1, a counterplate 17, and the set of tumblers 6 of the lock is mounted between the plates 1 and 17. In this case, the shaped stud 23 has a tang 18 inserted into a seating 1' of plate 1, and a shoulder 19 inserted into a seating 17' of counterplate 17. Preferably the shaped stud 23 is further provided with a grasping means 20, and with a projection 21, which prevents it from being assembled in overturned position and has radiusing slopes 22. With said latter portions cooperates a profiled spring 24, fixed to the plate 17, for example by means of a fastening plaque 25, as shown in FIGS. 8 to 10. Thanks to these features, the shaped stud 18,23 can be interchanged on the plates 1 and 17 by a very easy operation, thereby to adapt the lock to be operated by a different key. The grasping means 20 of the shaped stud 23 is made accessible through a suitable opening provided on the lock casing, at the inner side of the door to which the lock is applied.

Figure 12:
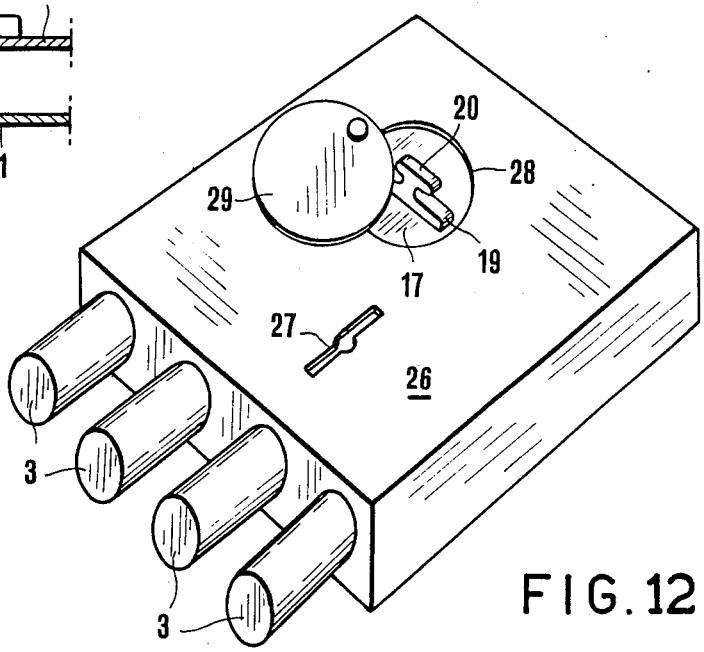
FIG. 12 is a perspective view of a lock with an opening for interchangeably mounting the shaped consent stud.

In this respect, for the already stated reasons, it is desirable to avoid that the shaped stud 23 could be replaced when the lock is in a normal position, i.e. in a completely open or a completely closed position. To this end, as shown in FIG. 12, the lock casing 26, in which the keyhole 27 is formed, is provided with an opening 23 for access to the shaped stud 23, and said opening 28 has a limited width and is situated in register with the stud 23 when the lock is in an intermediate position, for example in correspondence to the second turn of closure. Therefore, it is normally needed to have the old key to bring the lock to this intermediate position, before having access to the shaped stud and be allowed to its substitution in order to adapt the lock to a new key. The opening 28 may be normally covered by a simple oscillating plaque 29 of the same type which is often used to cover the keyhole 27.

Figure 6:
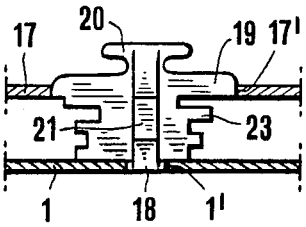
FIG. 6 is a front view of an exemplary shaped consent stud interchangeably mounted on the plate with latches.
Figure 7:
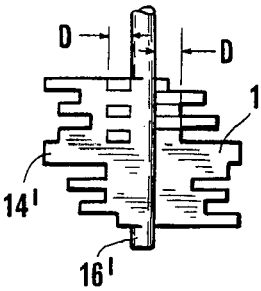
FIG. 7 shows the shape of the key web which corresponds to the consent stud of FIG. 6 when tumblers with windows according to FIGS. 2 and 3 are used.

Mounting the consent stud of the lock between two plates, as shown in the embodiment of FIGS. 6 and 8, provides a considerable increase of resistance of the lock against picking attempts. Therefore, the arrangement of the consent stud supported at both ends by two plates of the system of latches may be advantageously adopted even when replaceability of the consent stud is not provided for. Nevertheless, in certain cases it may be preferred for constructional reasons that the consent stud (either replaceable or not) be mounted on a single plate 1 (arranged below the tumblers 6) or 17 (arranged above said tumblers).

Figure 11:
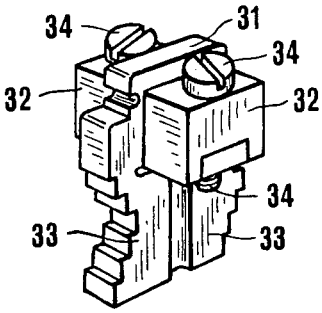
FIG. 11 is a perspective view of another embodiment of the interchangeable consent stud.

Another embodiment of the shaped consent stud is shown in FIG. 11. In this case, the stud comprises a profiled block 33, which terminates upwardly in a fastening and grasping head 31 provided with tabs 32 with bores. The block 33 may be fixed to a plate 1 or 17 by means of screws 34 passing through the bores of the tabs 32. The screws 34 may possibly be mounted on the tabs 32 in such a manner as not to be allowed to come out therefrom. Of course, with this embodiment, mounting and replacing the shaped stud requires the use of a tool, such as a screwdriver.

When a lock according to the invention is to be provided with a spring latch (the so called half turn), it is necessary that such latch be actuated by means of a further displacement of the latches system beyond its position of complete opening, in a manner per se known in the art. In the case of the invention, the more usual system of providing on the tumblers special slits for actuating the half turn cannot be applied, due to the fact that the tumblers have no pre-established opening position when a shaped consent stud is used.

A lock according to the invention allows replacing the key coordinated therewith, by a simple and economical operation, whenever the occasion arises, for example when a key has been lost or has been possessed by an untrustworthy person, or for any other reason. This advantage of the lock can be systematically used, in particular, when constructing a building. All the flats can be initially provided with locks having identical keys, whereby the labor may have access to all flats by using a single key, while each lock will be personalized at the time of the inhabitation of the corresponding flat. In similar manner, the lock may be differentiated when changing the tenant of a residence of the like. However, it is intended that a lock according to the invention be not only suitable for doors of premises but also for safes, shutters or other mobile closures to be protected. Moreover, as usual, the lock can be made available both in projecting and in recessed execution.

Of course, the particular arrangements set forth above may vary in the different practical applications. So may vary the number of turns of the lock and/or the number of tumblers forming the set. The lock may be provided with the usual control means and transmissions for vertical and horizontal latches, and with any other known fitting. When the shaped consent stud is replaceable, also the means for its insertion and retention in the correct position within the system of latches may vary. Finally, embodiments with a semifixed shaped consent stud are also conceivable in which the shaped stud which individualizes the lock, though not being immediately accessible and replaceable as in the embodiments shown in FIGS. 6 to 12, may be replaced in the system of latches after having dismounted the casing from the lock or after having dismounted the lock from the door or other support.

What is claimed is:

1. In the combination of a lock and a key, said lock being intended to cooperate with a strike plate and to be operated by said key, said key having at least one web comprising a sequence of teeth, said lock comprising a casing, at least one plate mounted in said casing for movement in a longitudinal direction therein under action of said key, at least one bolt mounted on said plate, said bolt extending along said longitudinal direction and being adapted to cooperate with a said strike plate, a consent stud mounted on said plate and extending perpendicularly to said longitudinal direction, and a set of superposed tumblers mounted in said casing for movement, under action of said key, in a transverse direction perpendicular to said longitudinal direction of movement of the plate, each said tumbler having an opening adapted to cooperate with one of said teeth of the key web, said openings being identical for all said tumblers, each said tumbler having a window extending in its said longitudinal direction and a number of pairs of opposed teeth extending along said transverse direction and protruding into said window, said pairs of opposed teeth defining a longitudinal passage in each said tumbler for passage of a corresponding portion of said consent stud in said longitudinal direction, said consent stud of the plate traversing the windows of all said superposed tumblers, in order to allow longitudinal movement of said plate only when said lock is operated by said key, the improvement in which said consent stud is removably mounted on said plate and comprises an integral plurality of superposed portions offset relative to one another in said transverse direction, each said portion of said consent stud being able to pass through the said longitudinal passage of the corresponding tumbler, said key web and said consent stud being so dimensioned that engagement of said key web teeth with said tumbler openings adapted to cooperate with said key web teeth will move said set of superposed tumblers from an initial locked position to a final position wherein each said portion of said consent stud is centered in the corresponding longitudinal passage of each said tumbler, said plate being movable in said longitudinal direction only after said set of tumblers has been moved to said final position by said key, whereby the character of said lock may be changed simply by changing said consent stud, and changing said key in a corresponding manner.

2. A lock and key according to claim 1, wherein said set of superposed tumblers comprises tumblers of odd position all identical to each other, and tumblers of even position also identical to each other but different from the tumblers of odd position.

3. A lock as set forth in claim 2, wherein the tumblers of odd position and the tumblers of even position differ in an inverted difference (D) of length of the opposed teeth of the successive pairs of teeth, a corresponding difference in length being provided, alternately in opposite directions, in the successive offset portions of the shaped consent stud with respect to the corresponding teeth of the web of the corresponding key.

* * * * *